United States Patent [19]

Schädlich et al.

[11] 4,360,048

[45] Nov. 23, 1982

[54] POWER DRIVEN, HAND OPERATED PLANE

[75] Inventors: Fritz Schädlich, Leinfelden-Echterdingen; Gerhard Armbruster, Stuttgart-Plieningen; Werner Neubert, Stuttgart; Peter Stierle, Waldenbuch, all of Fed. Rep. of Germany

[73] Assignee: Robert Bosch GmbH, Stuttgart, Fed. Rep. of Germany

[21] Appl. No.: 213,545

[22] Filed: Dec. 5, 1980

[30] Foreign Application Priority Data

Dec. 11, 1979 [DE] Fed. Rep. of Germany ... 7934812[U]

[51] Int. Cl.[3] ..... B27C 1/10

[52] U.S. Cl. ..... 145/4; 144/117 C

[58] Field of Search ..... 144/117 C; 145/4, 4.1

[56] References Cited

U.S. PATENT DOCUMENTS

| | | | |
|---|---|---|---|
| 3,207,195 | 9/1965 | Anton | 144/117 C |
| 3,253,624 | 5/1966 | Fegan et al. | 144/117 C |
| 3,407,857 | 10/1968 | Bentley | 145/4 |

*Primary Examiner*—W. D. Bray

*Attorney, Agent, or Firm*—Michael J. Striker

[57] ABSTRACT

The power driven, hand operated plane of the type having a fixed front guiding plate adjoining the circular path of movement of the planing knife, and a vertically adjustable rear guiding plate controlled by an adjustment device assembled of a control disk mounted at one end of a screw spindle and projecting partially from the housing; the other end of the spindle engages a nut which is secured to the shoe by a preadjustment mechanism; a biasing spring presses the shoe against the nut; a dial provided on top of the control disk is visible to the user through a window in the housing.

13 Claims, 5 Drawing Figures

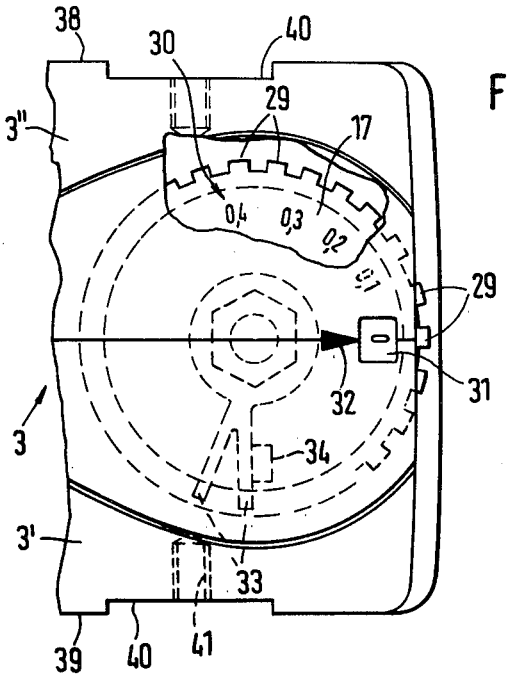
FIG.2
FIG.3
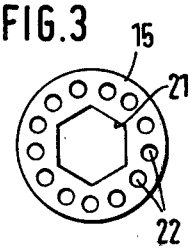
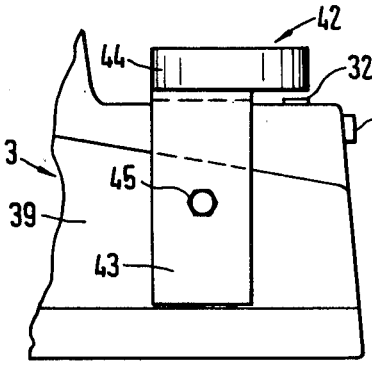
FIG.4
FIG.5
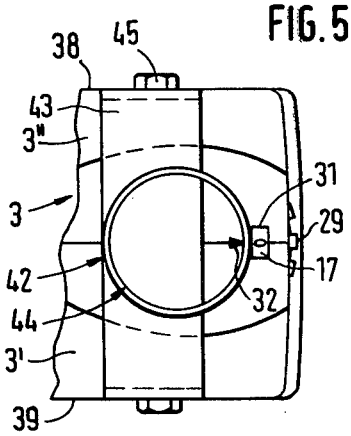

POWER DRIVEN, HAND OPERATED PLANE

BACKGROUND OF THE INVENTION

The present invention relates in general to a hand guided plane driven by electric motor, and in particular to a plane of the type that includes a housing, a handle on the housing, a rotary shaft arranged within the housing for supporting at least one planing knife, a first guiding plate mounted on the housing and adjoining the path of movement of the planing knife, an adjustable shoe guided in the housing, a second guiding plate formed on the shoe and being substantially flush with the first guiding plate, and an adjustment device mounted on the housing and engaging the shoe.

A plane of this type, driven by an electric motor, is disclosed in the U.S. Pat. No. 3,407,857. This known plane has a housing provided with a yoke-shaped handle, a rotary shaft supporting a planing knife for orbiting in the housing, a first guiding plate connected to the housing and being directed parallel to the rotary shaft, an adjustable shoe guided substantially at right angles to the first guiding plate and being formed with a second guiding plate extending flush with the first guiding plate, and an adjustment device for the shoe. The adjustment device engages the shoe and thus the second guiding plate in such a manner that the latter is vertically adjusted relative to the path of movement of planing knife mounted on the rotary shaft and thus adjusts the depth of cut of the plane. The prior-art adjustment device consists of a hexagonal screw which is directed perpendicularly to the path of movement of the setting shoe and connected to the housing; a lever pivotable about the axis of the hexagonal screw and being formed with an eccentric; and a sliding ring surrounding the eccentric, the ring being displaceable in a slot formed in the adjustment device and extending parallel to the second guiding plate. By tilting the lever the eccentric is rotated and displaces the sliding ring along the slot, thus moving the adjustment device relative to the first guiding plate. The disadvantage of this known adjustment device is the fact that it is composed of many complicated component parts which must engage each other substantially without play. Consequently, the production of such accurate component parts is very expensive.

From the German patent publications (Gebrauchmusters) Nos. 7131774 and 77010174 planes are known which have a simpler design of their adjustment devices. These planes are provided with rotary handles having a substantially mushroom-like shape to act as an adjustment handle which acts via threaded spindles and nuts on the adjustable shoe formed with the second guiding plate. Between the shoe and the housing there are arranged springs which press the two parts apart. In rotating the adjustment handle for the largest depth of cut, the biasing springs become compressed. The latter adjustment devices are simpler in structure than those according to the abovementioned U.S. Pat. No. 3,407,857. Their disadvantage, however, is the feature that the adjustment handle serves simultaneously as a handle for guiding the plane itself, and consequently an unintentional change of the depth of cut of the plane can hardly be avoided during operation. The plane according to the German Gebrauchsmuster No. 7131774 is also provided with a circular setting index dial arranged on the housing concentrically to the rotary handle, the latter being provided with a pointer for adjusting the desired depth of cut. The disadvantage of this arrangement of the setting dial is the inconvenience to read respective settings of the depth of cut from different zones relative to the housing. This inconvenience also impedes fast setting of the depth of cut. In addition, the readings on dials in the planes according to the aforementioned Gebrauchsmuster do not correspond to the actual settings as soon as the adjustment handles are turned around from their zero position by more than one rotation.

SUMMARY OF THE INVENTION

It is therefore a general object of the present invention to overcome the aforementioned disadvantages.

More particularly, it is an object of the invention to provide an improved plane of the above-described type in which the setting device operates without play and can be manufactured more economically.

Another object of the invention is to provide an improved plane which is protected against an unintentional misadjustment during the planing operation.

A further object of the invention is to provide such an improved plane in which the respective positions of the adjustment device are readable always at the same point irrespective of the number of rotations so that the dial always corresponds with the setting of the depth of cut.

In keeping with these objects and others which will become apparent hereafter, one feature of the invention resides, in a power driven, hand operated plane of the above-described type, in the provision of an adjustment device for the second guiding plate supporting shoe which includes a control member supported for rotation on the housing, a screw spindle attached at one end thereof to the control member, a nut engaging the spindle and supporting the shoe, a biasing spring provided in the housing to compress the shoe against the nut, and stop means for limiting the rotation of the spindle.

In the preferred embodiment of this invention, the control member is in the form of a disk which is partially covered by the housing and supports the setting dial. In the preferred embodiment, the adjustment device also includes a presetting mechanism in the form of a presetting disk which is formed with a central polygonal hole fitting the edges of the adjustment nut and is also formed with a plurality of perforations arranged around the central hole of the adjustment disk; an arresting screw passing through a selected perforation holds the presetting disk and thus the nut in a desired fixed position relative to the plane housing.

The housing is also provided with means for mounting thereon an adapter which in turn can be secured to a supporting frame and in this manner the portable plane is converted into a stationary planing machine. If a drill stand having a lifting carriage is provided with a clamping eye for adjusting the adpater at different vertical positions, the plane according to this invention can be used also as a so-called reduction plane.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 2 is a plan view, shown on an enlarged scale, of a cut-away portion of the plane of FIG. 1;

FIG. 3 is a plan view of a preadjustment disk in the plane of FIG. 1;

FIG. 4 is a cut-away side view of the plane of FIG. 1 with an attached adapter; and FIG. 5 is a plan view of the adapter of FIG. 4.

DESCRIPTION OF THE PREFERRED EMBODIMENTS

Figure 1:
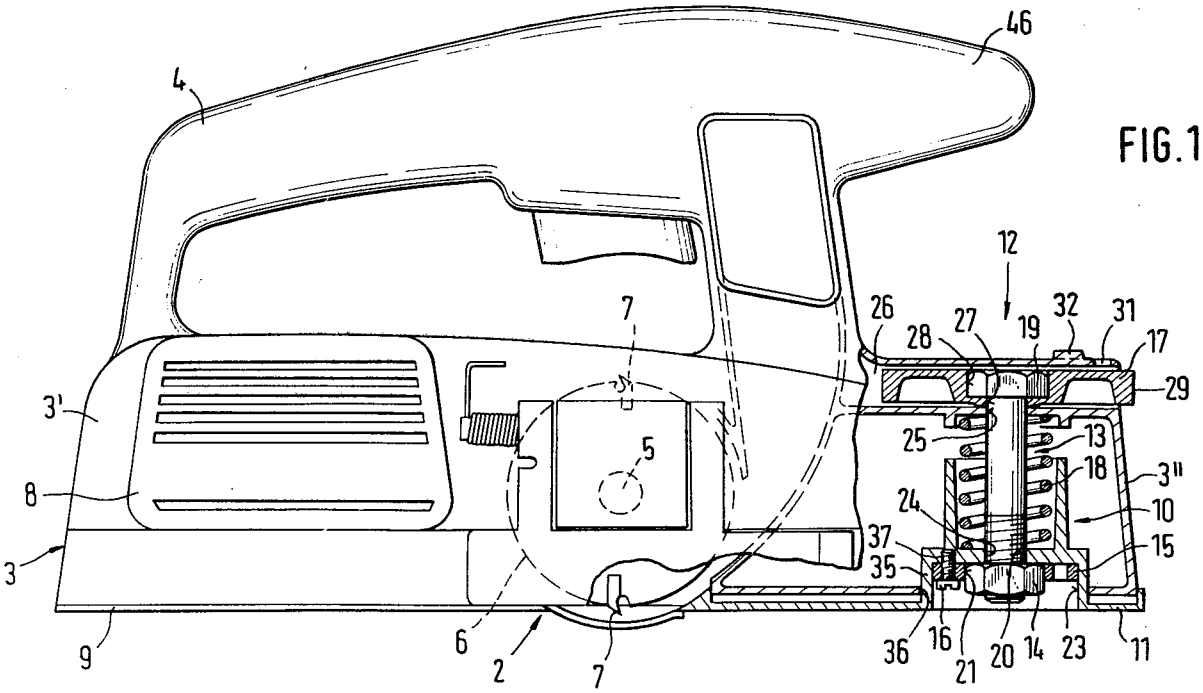
FIG. 1 is a side view, partly in section, of the plane according to this invention.

Referring firstly to FIGS. 1 and 2, the plane of this invention includes a housing 3 assembled of two half shells 3' and 3'' and being provided with a handle 4. A rotary shaft 5 is supported for rotation in the housing 3 and supports planing knife 7 mounted in a cylindrical holder 6. An electrical motor 8 for driving the shaft 5 is arranged in the front part of the housing 3 and the bottom of this front part is formed with a first guiding plate 9 rigidly connected to the housing. The rear part of the housing guides a tubular extension of an adjustable shoe 10 formed with a second guiding plate 11. The vertical position of the second guiding plate is adjustable by means of an adjustment device 12.

According to this invention, the adjustment device 12 is assembled of a threaded spindle 13, a nut 14, a preadjusting disk 15, an arresting element 16, a control disk 17 and a biasing spring 18.

The threaded spindle 13 is in the form of a commercially available screw formed with a hexagonal head 19 and a threaded steam 20. The head of the spindle may have also a different configuration, for example a rectangular shape. Also, instead of the conventional threaded screw, it is possible to employ a cast screw having steeper thread, for example of a trapezoidal cross section. The nut 14 engaging the threaded stem of the spindle 13 is also preferably a commercially available nut having for example a hexagonal or square shape. The preadjusting disk 15 is formed with a polygonal central hole 21 snugly fitting the periphery of the nut 14, and with a plurality of smaller holes 22 arranged in a circle along the circumference of the disk 15. The adjustment shoe 10 is formed with a tubular recess 23 starting at the second guiding plate 11. The preadjusting disk 15 is arranged in this tubular recess 23 and is held in position relative to the shoe 15 by an arresting element 16 in the form of a screw with a cylindrical head. The bottom of the recess 23 is provided with a hole 24 located concentrically to the hexagonal central hole in the disk 15 for passing through the threaded stem of the spindle 13. Similar hole 25 is formed also in the upper wall of the housing 3 opposite the lower hole 24 to accommodate the stem 20 of the spindle 13. The upper hole 25 is located below a housing cover so that a pocket 26 is formed between the housing and the cover to receive a control disk 17.

The control disk 17 is formed with a polygonal hole 28 matching the hexagonal head 19 of the spindle and the circumference of the control disk is knurled or provided with control teeth 29. A setting dial 30 corresponding to the depth of cut to be adjusted is arranged on the upper face of the disk 17. A window 31 is provided in the cover of the pocket 26 opposite the dial 30. A pointer 32 on the cover of the pocket 26 is directed to the center of the window 31. The stem 20 of the spindle 13 passes through the aligned holes 27, 25 and 24 in the disk 17, the housing 3 and the recessed part of the shoe 10, and the head of the spindle thus holds the control nut 17 in position in the pocket 26. The control teeth 29 project through the open side of the pocket 26 and partially overlap the rear wall of the housing 3. A biasing spring 18 is inserted around the stem 20 between the inner wall of the housing 3 and the adjustable shoe 10. The spring 18 tends to displace the two parts one from the other. A forked-shaped stop member 33 is formed in radial direction on the body of the control disk 17. This fork-shaped member 33 abuts on a stationary stop member 34 arranged in the pocket 26 in the path of movement of the stop member 33 so that the control nut 17 is prevented from turning about a full circle. When assembling the plane tool of this invention, the threaded spindle 13 is first inserted into the center hole 27 of the control disk 17 whereby the hexagonal head 19 snugly fits the central polygonal hole 28 in the disk. Thereupon the preassembled spindle 13 with the control disk 17 are inserted into a half shell of the housing 3. Then the second half shell of the housing 3 is unified with the first one and the biasing spring 18 is inserted on the stem of the spindle 13. Thereafter the adjustable shoe 10 is compressed against the force of the spring 18 and is inserted into the interior of the housing 3 to such an extent until the threaded part 20 of the spindle projects through the lowermost hole 24 whereby the outer surface 35 of the recessed portion 23 is guided in a corresponding guiding opening 36 in the bottom of the rear part of the housing 3. Finally the nut 14 is screwed on the threaded part 20 of the spindle 13. The preadjustment of the resulting setting device 12 is made as follows: The control disk 17 is rotated until the starting point "0" of the dial 30 is displayed in the window 31 whereby the stop members 33 and 34 engage each other. In this position, the hexagonal spindle nut 14 is rotated so long until the plane of the second guiding plate 11 is flush with the plane of the first guiding plate 9. Thereafter the preadjustment disk 15 is inserted into the recess 23 to engage the nut 14 whereby one of its arresting holes 22 is at least approximately in register with a threaded hole 37 formed in the bottom of the recess 23. The preadjustment ring 15 is then secured in this position or if necessary after a minute rotation by an arresting screw 16 engaging the threaded hole 37. In this simple manner, the "0" position of the adjustment device 12 is preset with sufficient accuracy. After the completion of the preadjustment process by arresting the disk 15 by the screw 16, the control disk 17 can be rotated about its axis until the second arm of the fork-shaped stop member 33 abuts from the other side against the stationary stop member 34. Due to the fact that the control ring 17 can perform less than one full rotation, the "0" position during the return movement in opposite direction can be located without any positioning error.

In a modification, the setting dial 30 on the control disk 17 can be made shiftable relative to the stop member 33, so that additional adjusting possibilities are created before the "0" position and the subsequent indication of the depth of cut. When, after the completion of the planing work, this additional adjustment is needed whereby the second guiding plate 11 is so adjusted by the threaded spindle 13 as to project above the first guiding plate 9, the advantage is achieved that the planing knife 7 cannot contact the surface on which the plane is standing, and consequently damage of the underlying surface and the running of the plane when the driving motor is accidentally switched on, are effectively prevented.

Two opposite lateral sides 38 and 39 of the housing 3 are formed with elongated recesses 40 provided with threaded bores 41 serving for the reception of a conventional groove depth limit stop, a guiding stop, or another adapter for the tool, consisting of a U-shaped yoke 43 matching the recesses 40 and of a cylindrical mounting attachment 44. The adapter 42 is connected to the housing 3 by fastening screws 45. The adapter is used in the case when the plane 2 is not intended to be operated manually. The mounting attachment 44 is clamped in a non-illustrated base. The plane 2 can be clamped in a reversed position in which the guiding plates 9 and 11 are situated on top so that the plane is usable as a stationary planing machine. Alternatively, the adapter 42 can be attached in its normal position when the guiding plates 9 and 11 are directed downwardly, to the carriage of a conventional drilling or milling machine. In this connection, the plane 2 can be employed for uniformly planing a workpiece to a predetermined thickness.

Instead of a detachable adapter 42, the mounting attachment 44 can be permanently connected to the housing 3.

In another modification, a conventional locking washer with a tab or nose can be used instead of the aforedescribed arresting disk 15 and the separate arresting element 16.

In order to facilitate the guiding of the plane by the handle 4, the latter is provided at its rear part with a guiding knob 46 which is directly connected to the housing 3 as illustrated in FIG. 1 or can be detachably connected to the housing by suitable screws or clamps. A removable guiding knob has the advantage that it enables an easier installation of the plane into a drill stand.

It will be understood that each of the elements described above, or two or more together, may also find a useful application in other types of constructions differing from the types described above.

While the invention has been illustrated and described as embodied in a power driven, hand operated plane, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a power driven, hand operated plane including a housing, a handle on the housing, a rotary shaft arranged within the housing for supporting at least one planing knife, a first guiding plate mounted on the housing and adjoining the path of movement of the planing knife, an adjustable shoe guided in the housing, a second guiding plate formed on the shoe and adjoining the path of movement of the planing knife opposite the first guiding plate, a combination comprising an adjustment device mounted on the device and engaging said shoe, said adjustment device including a control disk arranged in the housing opposite said shoe and being provided on its face with a control dial; a screw spindle attached at one end thereof to said control disk; a spindle nut attached to said shoe and engaging the other end of said spindle; a biasing spring provided between said housing and said shoe; and stop means formed between said control disk and said housing to limit the rotation of said control disk.

2. A combination as defined in claim 1, wherein said screw spindle is a screw having a polygonal head and said nut having a polygonal contour, said control disk having a center opening snugly fitting the polygonal head of said screw, and said adjustable shoe having a hollow cylindrical extension with a central hole for passing through the other end of said spindle and for accommodating said nut, and a preadjustment mechanism provided between said nut and said cylindrical extension.

3. A combination as defined in claim 2, wherein said preadjustment mechanism includes a disk having a polygonal central hole snuggly fitting the contour of said nut, a plurality of setting holes distributed around said polygonal central hole, and an arresting screw passing through one of said setting holes and engageable with a threaded bore in said cylindrical extension.

4. A combination as defined in claim 1, wherein said housing is provided with a window located above said dial to facilitate the reading of the adjusted position of said shoe.

5. A combination as defined in claim 4, wherein said window is provided with a pointer.

6. A combination as defined in claim 1, wherein said stop means includes a fork-like stop member formed on said control disk and a stationary abutment formed on said housing in the range of movement of said stop member.

7. A plane as defined in claim 1, wherein said housing is formed with means for attachment of the plane to a base such as a drilling and/or milling frame.

8. A plane as defined in claim 7, wherein said means includes elongated recesses formed on opposite lateral walls of the housing to hold a corresponding mounting adapter.

9. A plane as defined in claim 8, including a mounting adapter formed of a U-shaped yoke engaging said lateral recesses in the housing, the top of said yoke being formed with a mounting shoulder.

10. A plane as defined in claim 7, wherein said attachment means includes a mounting shoulder rigidly connected to said housing.

11. A plane as defined in claim 1, wherein said handle extends above a front part of said housing and is provided with a rearwardly directed guiding knob projecting above said adjustment device.

12. A plane as defined in claim 11, wherein said guiding knob is detachably connected to said housing.

13. A combination as defined in claim 1, wherein said adjustment device has a zero position of said control disk in which said second guiding plate is outwardly offset from the plane of said first guiding plate at a distance which exceeds the circular path of movement of said planing knife.

* * * * *